US011686198B2

(12) United States Patent
Zhang et al.

(10) Patent No.: US 11,686,198 B2
(45) Date of Patent: Jun. 27, 2023

(54) REINFORCEMENT SYSTEM AT RAILWAY TUNNEL SECTION PASSING THROUGH KARST CAVE WITH LARGE DIP ANGLE AND CONSTRUCTION METHOD

(71) Applicants: CHINA RAILWAY 18 BUREAU GROUP CO. LTD., Tianjin (CN); LIAONING TECHNICAL UNIVERSITY, Fuxin (CN)

(72) Inventors: Xin Zhang, Tianjin (CN); Zhitao Zhao, Tianjin (CN); Jufa Xi, Tianjin (CN); Xiangping Zhang, Tianjin (CN); Baoxin Jia, Fuxin (CN); Jiashun Liu, Fuxin (CN)

(73) Assignee: CHINA RAILWAY 18 BUREAU GROUP CO. LTD., Tianjin (CN)

( * ) Notice: Subject to any disclaimer, the term of this patent is extended or adjusted under 35 U.S.C. 154(b) by 60 days.

(21) Appl. No.: 17/481,268

(22) Filed: Sep. 21, 2021

(65) Prior Publication Data

US 2023/0068068 A1 Mar. 2, 2023

(30) Foreign Application Priority Data

Aug. 31, 2021 (CN) ..... 202111008594.7

(51) Int. Cl.
*E21D 11/04* (2006.01)

(52) U.S. Cl.
CPC ..... *E21D 11/04* (2013.01)

(58) Field of Classification Search
CPC ..... E21D 11/04; E21D 11/10; E21D 11/107; E21D 11/18; E21D 11/183
See application file for complete search history.

(56) References Cited

FOREIGN PATENT DOCUMENTS

| | | | |
|---|---|---|---|
| CN | 101781990 A | * | 7/2010 |
| CN | 101922301 A | | 12/2010 |
| CN | 102493818 A | | 6/2012 |
| CN | 109736884 A | | 5/2019 |
| CN | 111119938 A | | 5/2020 |
| CN | 111322086 A | | 6/2020 |
| CN | 210829286 U | | 6/2020 |
| WO | 2018214737 A1 | | 11/2018 |

* cited by examiner

*Primary Examiner* — Sunil Singh
(74) *Attorney, Agent, or Firm* — SZDC Law P.C.

(57) ABSTRACT

The present invention relates to a reinforcement system at a railway tunnel section passing through a karst cave with a large dip angle and a construction method. The reinforcement system of the present invention can solve the problems of downward mud filling, watertightness, etc. of a top through structures of an umbrella arch, a concrete layer, a flexible buffer layer and a protective layer at the top, at a karst cave, of a tunnel, solve the problem of upward mud inrush at a bottom through structures of an anchor cable, a ring beam and a foundation pad at the bottom of the tunnel, guarantee stability of an arch bridge by erecting "a triple arch bridge" in a middle and adding a vertical bearing wall under the arch bridge, and make a railway safely cross the mud-inrush karst cave by safely laying a ballastless track on the bridge.

10 Claims, 5 Drawing Sheets

REINFORCEMENT SYSTEM AT RAILWAY TUNNEL SECTION PASSING THROUGH KARST CAVE WITH LARGE DIP ANGLE AND CONSTRUCTION METHOD

CROSS-REFERENCE TO RELATED APPLICATIONS

The present disclosure claims the priority to the Chinese patent application with the filing No. 2021110085947, filed with the Chinese Patent Office on 31 Aug. 2021, and entitled "REINFORCEMENT SYSTEM AT RAILWAY TUNNEL SECTION PASSING THROUGH KARST CAVE WITH LARGE DIP ANGLE AND CONSTRUCTION METHOD", which is incorporated herein by reference in its entirety.

TECHNICAL FIELD

The present invention relates to the technical field of tunnel collapse construction, in particular to a reinforcement system at a railway tunnel section passing through a karst cave with a large dip angle and a construction method.

BACKGROUND

During construction, tunnels pass through karst regions in many cases, and ground collapse, ground surface settlement, etc. caused by water or mud inrush resulting from karrens, underground rivers, karst caves, etc. of karst are likely to occur. For example, it is likely to form potholes at the tops of tunnels due to ground collapse. A conventional method is to clean up all gushed infill, construct umbrella arches at arches, use thick river sand as a buffer layer, construct cast-in-place bored piles and abutments in cavities at the bottoms of the tunnels, and cast in place prefabricated simply supported beams on which ballastless tracks are constructed. Karst caves with dip angles greater than 60° are called karst caves with large dip angles or vertical karst caves.

However, due to rocks falling from the tops of the karst caves and water leaking along fissures in rainy seasons, the anti-buffering capacity of filling sand is limited and water is prone to accumulation. Limestone covering the cavities at the bottoms of the tunnels makes non-blasting excavation difficult. However, in the case of blasting excavation, apart from the danger of landslide due to rock damage, potential safety hazards as a result of cavity disturbance mud inrush are also caused. It takes a long construction period to construct pile foundations, caps and simply supported beam bridges, and especially the pile foundations deeper than 70 meters are extremely difficult to construct in the tunnels. Moreover, settlement and convergence observation of these structures constructed in the tunnels require a long time, which cannot meet the construction period requirement.

SUMMARY

In view of this, the present invention provides a reinforcement system at a railway tunnel section passing through a karst cave with a large dip angle and a construction method.

The reinforcement system specifically includes:

an umbrella arch, a concrete layer, a flexible buffer layer and a protective layer which are sequentially built at a top of a portion, passing through the karst cave, of a main tunnel from bottom to top; and an arch bridge which is built at a bottom of a portion, passing through the karst cave, of the main tunnel, where a filling layer made of concrete is arranged over the arch bridge, two arched door openings are reserved on two sides of the arch bridge, a bottom plate is arranged over the filling layer, the bottom plate is formed by pouring reinforced concrete, a foundation pad is arranged at a bottom of a foundation pit under the arch bridge, and a vertical bearing wall is built between the arch bridge and the foundation pad.

For discharging falling rock and inrush water in the karst cave, as well as convenient construction and later maintenance of the top (a portion above the protective layer) of the karst cave and the foundation pit, on the basis of the above structures, the reinforcement system further includes an emptying culvert parallel to the main tunnel, a bottom surface of the emptying culvert is lower than the bottom plate in height in a vertical direction, which is conducive to discharge of the falling rock and the inrush water. In addition, a cross passage is built between the main tunnel and the emptying culvert;

a construction cross passage is built between the emptying culvert and at the bottom of a portion, passing through the karst cave, of the main tunnel, openings, at a lower portion of the arch bridge, of the construction cross passage being located on two sides of the vertical bearing wall; and a circuitous passage is built between the cross passage and an upper portion of the protective layer, a bottom edge of an opening, at the upper portion of the protective layer, of the circuitous passage coincides with a bottom edge of the protective layer or is slightly lower than the bottom edge of the protective layer, for the purpose of outflow of falling rock and inrush water of the upper portion of the protective layer.

The foundation pad includes a ring beam, an intermediate beam and a pad layer, several anchor cables penetrating into a wall of the karst cave are arranged at half of a height of the foundation pad, and the vertical bearing wall is arranged on the intermediate beam.

A construction method of a reinforcement system at a railway tunnel section passing through a karst cave with a large dip angle specifically includes:

(I) Building a Protection Structure at a Top of the Tunnel building an umbrella arch at a top of a portion, passing through a karst cave, of a main tunnel, filling a top of the umbrella arch with plain concrete to form a concrete layer, stacking a sandbag on the concrete layer as a flexible buffer layer, and pouring reinforced concrete at a top of the flexible buffer layer to form a protective layer; and on the premise that the protective structure at the top of the tunnel provides sufficient supporting force for the tunnel at the karst cave, effectively buffering impact force of falling rock and automatically discharging water;

(II) Building a Foundation Pit excavating the foundation pit at a bottom of a portion, passing through the karst cave, of the main tunnel;

driving, after excavation of the foundation pit, anchor cables into walls of the karst cave on a periphery of a bottom of the foundation pit for fixing, where a free end of one anchor cable and a free end of another anchor cable driven into an opposite wall of the karst cave are fastened together by a buckle; and erecting reinforced beams on the periphery and in a middle of the bottom of the foundation pit, where the anchor cables are located at halves of heights of the erected reinforced beams, pouring concrete to form a ring beam and an intermediate beam, pouring concrete in a space between the ring beam and the intermediate beam to form a pad layer, and building a foundation pad; and (III) Building an Arch Bridge erecting, after step (II), an arch bridge by using reinforced concrete, pouring plain concrete at a top of the arch bridge to form a filling layer, and pouring reinforced concrete on an upper portion of the filling layer to serve as a bottom plate.

Specifically, a foundation (that is an arch foot) of the arch bridge is excavated towards two sides, such that a span of the arch bridge is greater than a width of the foundation pit, and the foundation of the arch bridge is located on hard rock (such as limestone and basalt). In order to improve stability, mortar anchors may be used, in a direction of inclining downwards by 45°, for supporting at the arch foot of the arch bridge.

When the concrete reaches a designed strength, C35 plain concrete is poured at the top of the arch bridge to form the filling layer, and two arched door openings are reserved on two sides of the arch bridge.

At last, after the C35 plain concrete of the filling layer reaches a designed strength, C35 reinforced concrete, which is 1.17 m in thickness, is poured on the upper portion of the filling layer to serve as the bottom plate, and the bottom plate is a bottom plate of a ballastless track (equivalent to an inverted arch filling layer).

For convenient construction and later maintenance of the top (a portion above the protective layer) of the karst cave and the foundation pit, before step (I), an emptying culvert is built at a position 35-45 m beside the main tunnel firstly, where the emptying culvert is parallel to the main tunnel, and a bottom surface of the emptying culvert is lower than the bottom plate by 2 m or more in height.

A cross passage is built between the main tunnel and the emptying culvert, and the cross passage is a construction passage between the main tunnel and the emptying culvert, where an included angle of 45° is formed between the cross passage and the main tunnel.

A construction cross passage is built between the emptying culvert and a space below the arch bridge and above the foundation pad, the construction cross passage is a construction channel between the emptying culvert and the cavity foundation pit, and a gradient of the construction cross passage is not greater than 15%.

A circuitous passage is built between the cross passage and an upper portion (the upper portion refers to an upper portion of a bottom edge of the protective layer) of the protective layer, a bottom edge of an opening, at the upper portion of the protective layer, of the circuitous passage coincides with a bottom edge of the protective layer or is slightly lower than the bottom edge of the protective layer, for the purpose of outflow of falling rock and inrush water of the upper portion of the protective layer. The circuitous passage is a passage for exploring the karst cave and maintaining the top of the karst cave in a later stage. Furthermore, when falling rock and inrush water occur at the top of the karst cave, the falling rock and inrush water may flow into the circuitous passage along a slope and the bottom edge of the protective layer and flow into the emptying culvert along the circuitous passage.

After the arch bridge is erected, in order to improve a bearing capacity of the arch bridge, after step (III), a vertical bearing wall, which is 30 cm in thickness, is built between the arch bridge and the foundation pad, and a bottom of the vertical bearing wall is arranged on the intermediate beam of the foundation pad. For convenient later maintenance of the foundation pit, a passage door is built on the vertical bearing wall, and openings, on a wall of the karst cave and below the arch bridge, of the construction cross passage are located on two sides of the vertical bearing wall.

The reinforcement system at a railway tunnel section passing through a karst cave with a large dip angle and the construction method of the patent may solve the problems of downward mud filling, watertightness, etc. of a top through structures of the umbrella arch, the concrete layer, the flexible buffer layer and the protective layer at the top, at the karst cave, of the tunnel, solve the problem of upward mud inrush at a bottom through structures of the anchor cable, the ring beam and the foundation pad at the bottom of the tunnel, guarantee stability of the arch bridge by erecting "a triple arch bridge" in a middle and adding the vertical bearing wall under the arch bridge, and make a railway may safely cross the mud-inrush karst cave by safely laying a ballastless track on the bridge.

BRIEF DESCRIPTION OF DRAWINGS

Various other advantages and benefits will become apparent to those of ordinary skill in the art through the following detailed description of preferred embodiments. The accompanying drawings are merely for the purpose of illustrating the preferred embodiments, but not to be considered as limiting the present invention. In the accompanying drawings.

DETAILED DESCRIPTION OF THE EMBODIMENTS

The following will describe exemplary embodiments of the present invention in more detail below with reference to accompanying drawings. Although the exemplary embodiments of the present invention are shown in the accompanying drawings, it should be understood that the present invention may be implemented in various forms and should not be limited by the embodiments set forth herein. On the contrary, these embodiments are provided for more thorough understanding of the present invention and may fully communicate the scope of the present invention to those skilled in the art.

Embodiment 1

Figure 1:
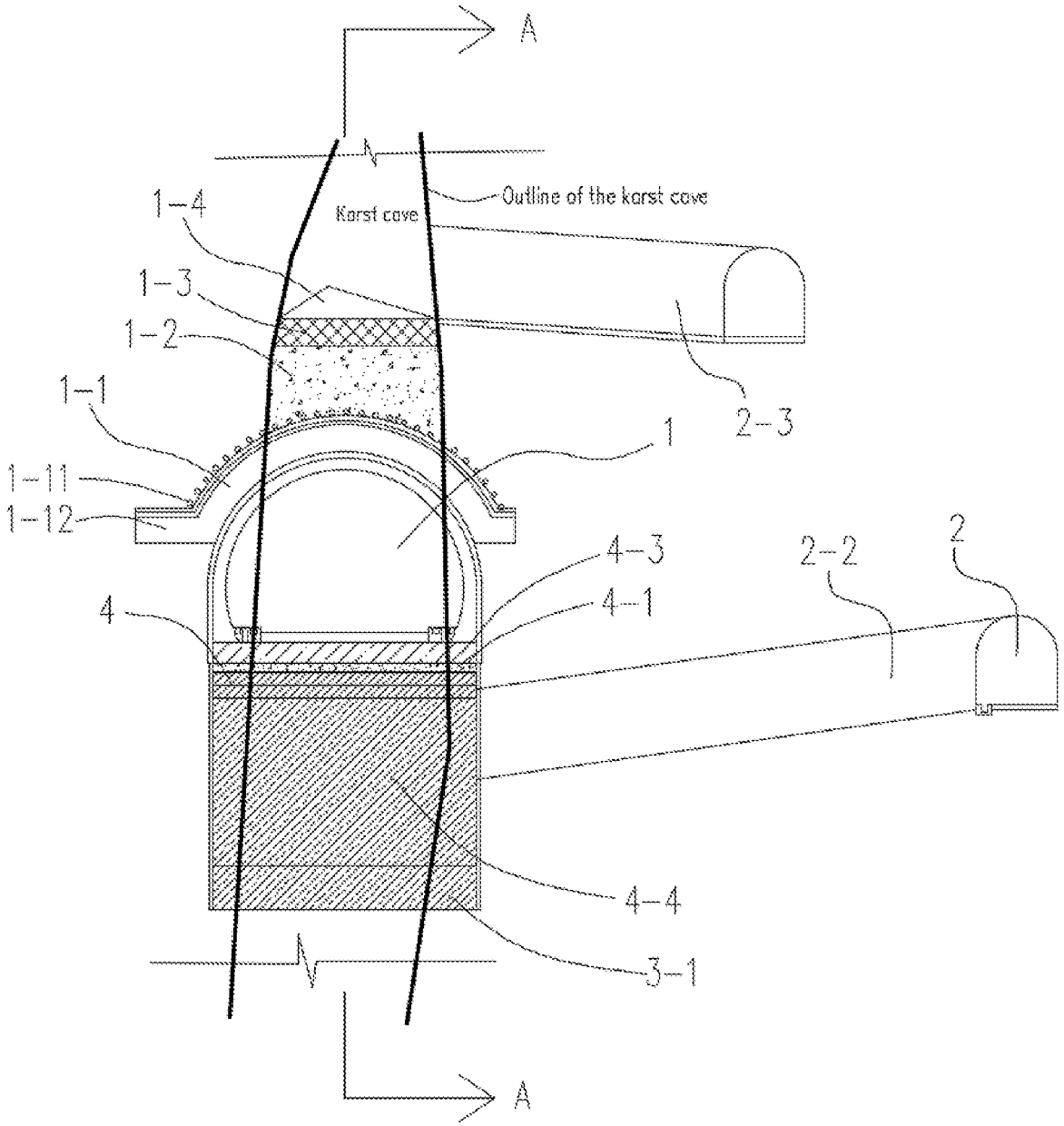
FIG. 1 is a schematic diagram of a construction structure of a tunnel section passing through a karst cave.
Figure 2:
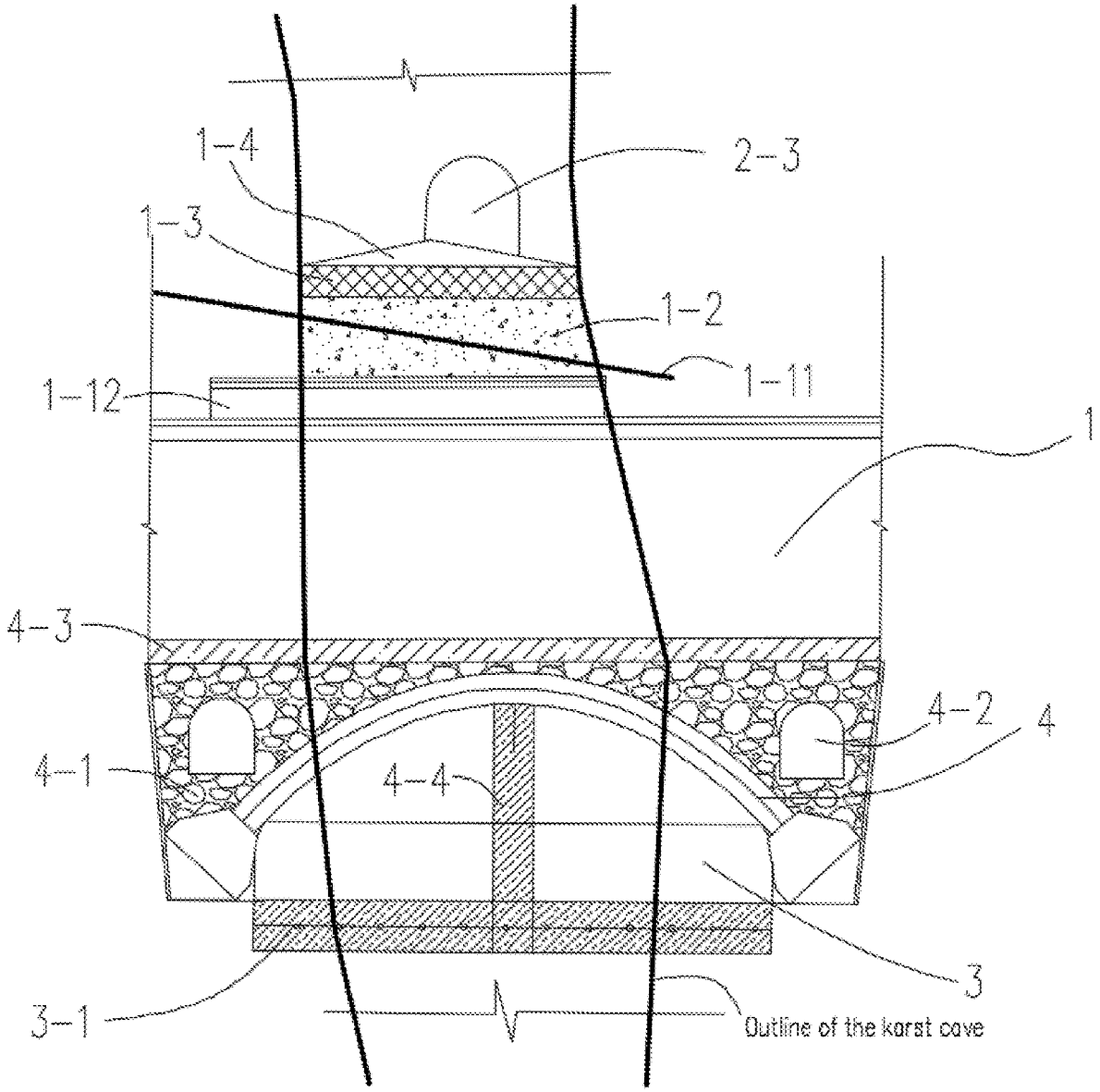
FIG. 2 is a schematic diagram (a schematic diagram in a direction of A-A) of the construction structure of a tunnel section passing through a karst cave.

As shown in FIG. 1 and FIG. 2, a reinforcement system at a railway tunnel section passing through a karst cave with a large dip angle specifically includes:

an umbrella arch 1-1, a concrete layer 1-2, a flexible buffer layer 1-3 and a protective layer 1-4 which are sequentially built at a top of a portion, passing through the karst cave, of a main tunnel 1 from bottom to top; and an arch bridge 4 which is built at a bottom of a portion, passing through the karst cave, of the main tunnel 1, where a filling layer 4-1 is arranged over the arch bridge 4, the filling layer 4-1 is formed by filling concrete, two arched door openings 4-2 are reserved at portions, on two sides of the arch bridge 4, a bottom plate 4-3 is arranged over the filling layer 4-1, the bottom plate 4-3 is formed by pouring reinforced concrete, a foundation pad 3-1 is arranged at a bottom of a foundation pit 3 under the arch bridge 4, and a vertical bearing wall 4-4 is built between the arch bridge 4 and the foundation pad 3-1.

Figure 3:
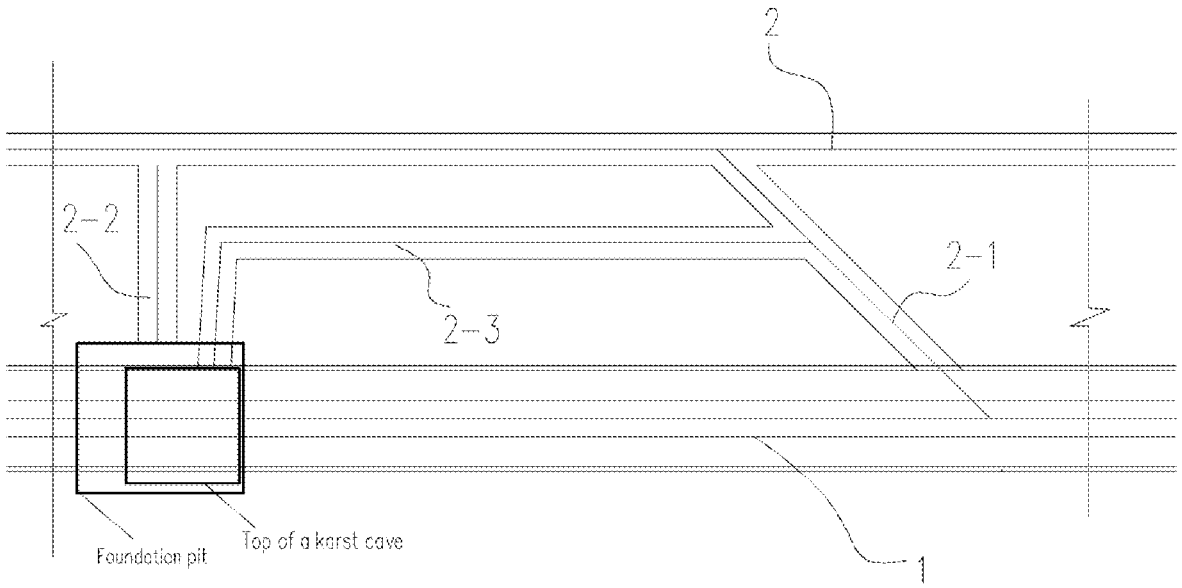
FIG. 3 is structural schematic diagrams of an emptying culvert, a main tunnel and the karst cave.

As shown in FIG. 1-3, preferably, for discharging falling rock and inrush water in the karst cave, as well as convenient construction and later maintenance of the top (a portion above the protective layer 1-4) of the karst cave and the foundation pit 3, on the basis of the above structures, the reinforcement system further includes an emptying culvert 2 parallel to the main tunnel 1, a bottom surface of the emptying culvert 2 is lower than the bottom plate 4-3 in height in a vertical direction, which is conducive to discharging of falling rock and inrush water. In addition, a cross passage 2-1 is built between the main tunnel 1 and the emptying culvert 2.

A construction cross passage 2-2 is built between the emptying culvert 2 and at the bottom of the portion, passing through the karst cave, of the main tunnel 1, openings, at a lower portion of the arch bridge 4, of the construction cross passage 2-2 being located on two sides of the vertical bearing wall 4-4.

A circuitous passage 2-3 is built between the cross passage 2-1 and an upper portion of the protective layer 1-4, a bottom edge of an opening, at the upper portion of the protective layer 1-4, of the circuitous passage 2-3 coincides with a bottom edge of the protective layer 1-4 or is slightly lower than the bottom edge of the protective layer 1-4, for the purpose of outflow of the falling rock and the inrush water of the upper portion of the protective layer.

Figure 7:
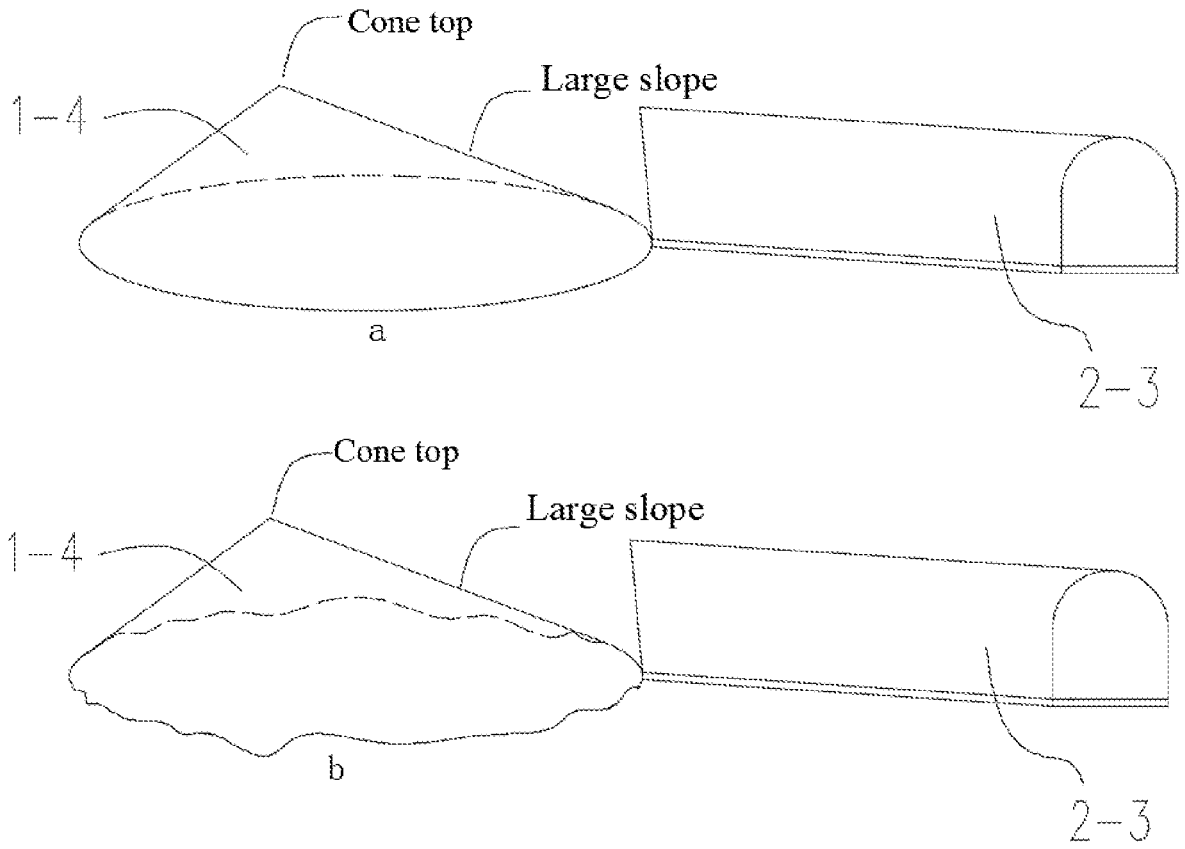
FIG. 7 is a schematic diagram of a position and a structure of a protective layer and a circuitous passage.

The protective layer 1-4 is in a shape of a cone with a lower portion wider than an upper portion, and a cone top inclining to a side far away from the circuitous passage 2-3, thus forming a slope with a larger area on a side close to the circuitous passage 2-3. After falling rock falls down from the top of the karst cave, more falling rock may directly fall on the slope close to the circuitous passage 2-3, and may directly roll into the circuitous passage 2-3 or roll to an entrance of the circuitous passage 2-3 from the slope under the action of gravity. Actually, as shown in FIG. 7, the protective layer 1-4 is cone but not a regular one since in a horizontal plane, the wall of the karst cave is not a regular circle. Figure a above is a regular cone, and figure b below is an irregular cone.

Figure 5:
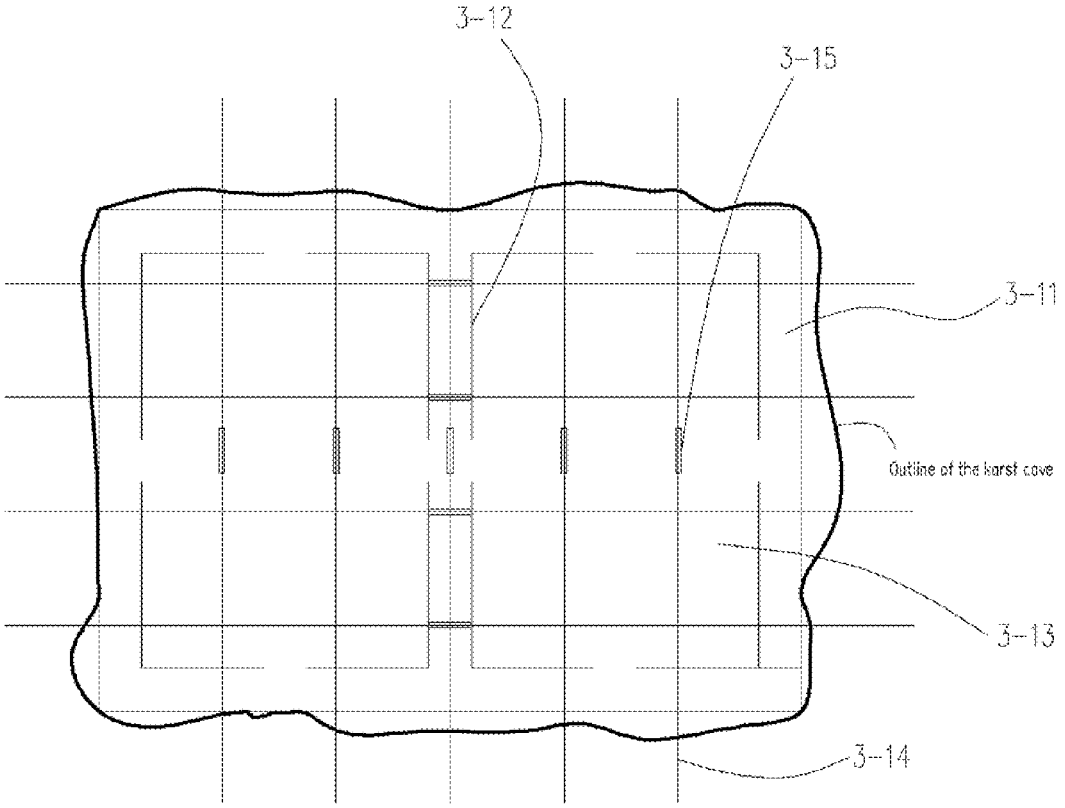
FIG. 5 is a structural schematic diagram of a foundation pad.
Figure 6:
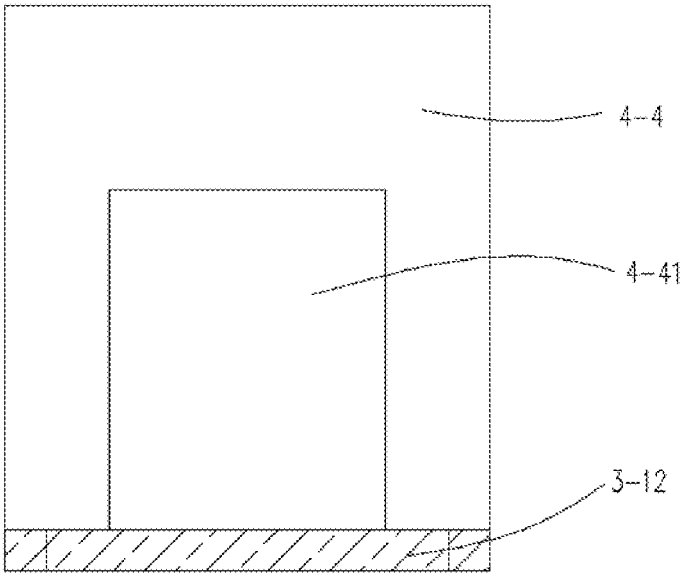
FIG. 6 is a structural schematic diagram of a vertical bearing wall.

As shown in FIG. 5, the foundation pad 3-1 includes a ring beam 3-11, an intermediate beam 3-12 and a pad layer 3-13, several anchor cables 3-14 penetrating into a wall of the karst cave are arranged at half of a height of the foundation pad 3-1, and as shown in FIG. 6, the vertical bearing wall 4-4 is arranged on the intermediate beam 3-12.

Embodiment 2

A construction method of a reinforcement system at a railway tunnel section passing through a karst cave with a large dip angle specifically includes:

(I) A Protection Structure is Built at a Top of the Tunnel

An umbrella arch 1-1 is built at a top of a portion, passing through a karst cave, of a main tunnel 1, a top of the umbrella arch 1-1 is filled with plain concrete to form a concrete layer 1-2, a sandbag is stacked on the concrete layer 1-2 to serve as a flexible buffer layer 1-3, and reinforced concrete is poured at a top of the flexible buffer layer 1-3 to form a protective layer 1-4.

When the umbrella arch 1-1 is built, a pipe-shed method is used for pre-supporting firstly, then a reinforced concrete umbrella arch is built. Specifically, φ159 m steel pipes 1-11 are used for pre-supporting at a distance of 10 cm outside a contour line of the umbrella arch, the steel pipes 1-11 are arranged with spacing of 50 cm, then a C35 reinforced concrete umbrella arch 1-12, which is 2 m in thickness, is built, circumferential rebar φ25@20 cm (φ25 means a diameter of the rebar being 25 mm, @20 cm means distribution spacing of the rebar being 20 cm) and longitudinal rebar φ14@25 cm have intra-rowspacing of 1.9 m, and a lining trolley is used as formwork of the umbrella arch.

After the concrete of the umbrella arch 1-1 reaches a designed strength, the top of the umbrella arch 1-1 is filled with C20 plain concrete, which is 4.0 m in thickness, to form the concrete layer 1-2.

After the concrete of the concrete layer 1-2 reaches 75% of the designed strength, a sandbag, which is 1.5 m in thickness, is stacked on the concrete layer 1-2 to serve as a flexible buffer layer 1-3.

Finally, reinforced concrete is poured at a top of the flexible buffer layer 1-3 to form a protective layer 1-4.

Specifically, reinforced concrete is poured at the top of the flexible buffer layer 1-3, and the longitudinal rebar and the circumferential rebar are φ14@20 cm with intra-row spacing of 15 cm. The protective layer 1-4 is arranged, such that when falling rock and inrush water occur in the karst cave, the falling rock and inrush water flow out along the circuitous passage 2-3 and are discharged through the water emptying culvert 2.

On the premise that the protective structure at the top of the tunnel provides sufficient supporting force for the tunnel at the karst cave, impact force of falling rock may be effectively buffered and water may be automatically discharged as well.

(II) Building of a Foundation Pit

The foundation pit 3 is excavated at a bottom of a portion, passing through the karst cave, of the main tunnel 1. In a process of excavating the foundation pit, if rock lithology of a wall of the karst cave is weak (such as sandy shale and kata-rocks), shotcrete anchor support shall be used on the wall of the karst cave in the process of excavating the foundation pit 3, and supporting is performed as the excavation proceeds. φ22 mortar anchors 3-2 are driven in a side wall of the foundation pit in a quincunx shape, with spacing of 1.0×1.0 m, and a length of 4 m each (the length may be set according to the rock lithology). A φ8 steel fabric is laid with a size of 200×200 mm, C25 concrete is sprayed with a thickness of 10 cm. After the shotcrete anchor support is completed, and steel pipe column purlins 3-3 are used as temporary reinforcement on a periphery of the foundation pit 3 to guarantee safety of construction of the foundation pit 3, and are demolished after the construction is completed, as shown in FIG. 4.

Figure 4:
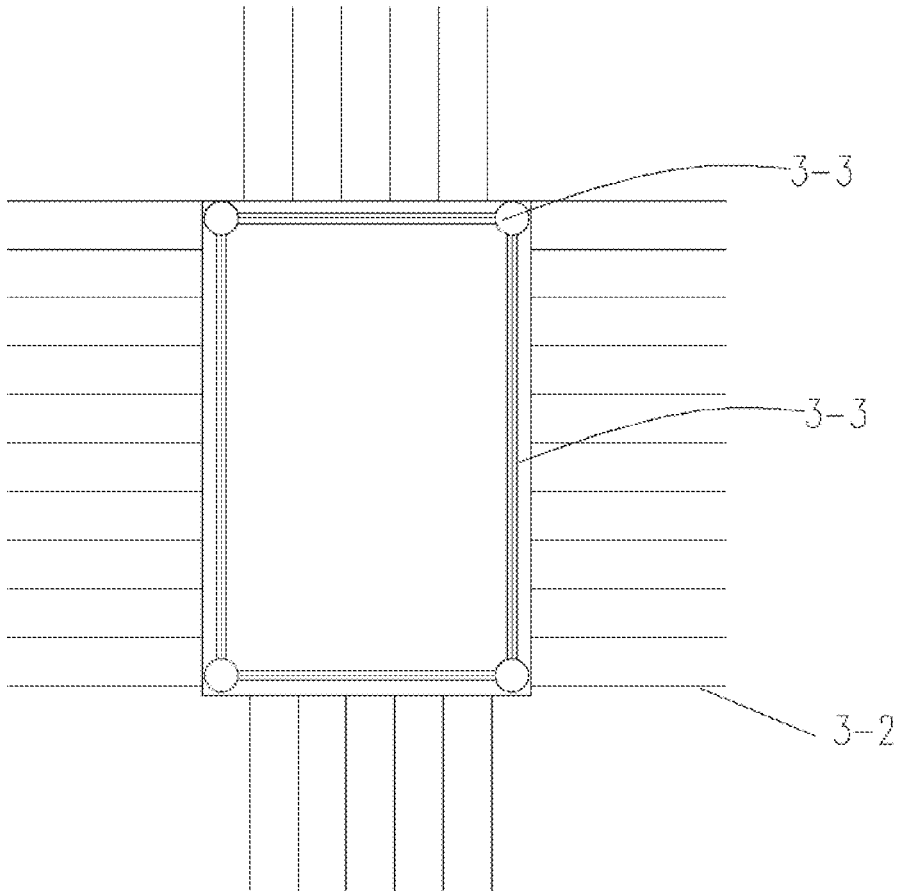
FIG. 4 is a structural schematic diagram of a top view of a foundation pit.

As shown in FIG. 4, after the foundation pit 3 is excavated, anchor cables 3-14 are driven into walls of the karst cave on a periphery of a bottom of the foundation pit 3 for fixing, where a free end of one anchor cable 3-14 and a free end of another anchor cable 3-14 driven into an opposite wall of the karst cave are fastened together by a buckle 3-15.

Reinforced beams are erected on the periphery and in a middle of the bottom of the foundation pit 3 by using rebar, where the anchor cables 3-14 are located at halves of heights of the erected reinforced beams, then concrete is poured to form a ring beam 3-11 and an intermediate beam 3-12, finally, concrete is poured in a space between the ring beam 3-11 and the intermediate beam 3-12 to form a pad layer 3-13, and a foundation pad 3-1 is built with a thickness of 40 cm.

(III) Building of an Arch Bridge

After step (II), an arch bridge 4 is erected by using reinforced concrete, then plain concrete is poured at a top of the arch bridge 4 to form a filling layer 4-1, and reinforced concrete is poured on an upper portion of the filling layer 4-1 to serve as a bottom plate 4-3.

Specifically, a foundation (that is an arch foot) of the arch bridge 4 is excavated towards two sides, such that a span of the arch bridge 4 is greater than a width of the foundation pit, and the foundation of the arch bridge 4 is located on hard rock (such as limestone and basalt). In order to improve stability, mortar anchors may be used, in a direction of inclining downwards by 45°, for supporting at the arch foot of the arch bridge.

A full support is erected at the bottom of the foundation pit, a bottom form is mounted, arch bridge steel rebar is assembled, a side form and a top form are mounted, a construction joint is reserved between left and right decks, and concrete is poured.

When the concrete reaches a designed strength, C35 plain concrete is poured at the top of the arch bridge 4 to form the filling layer 4-1, two arched door openings 4-2 are reserved on two sides of the arch bridge 4, and the plain concrete refers to non-reinforced concrete or concrete without tensioned bar.

Finally, after the C35 plain concrete of the filling layer 4-1 reaches a designed strength, C35 reinforced concrete, which is 1.17 m in thickness, is poured on the upper portion of the filling layer 4-1 to serve as the bottom plate 4-3, circumferential rebar φ25@20 cm and longitudinal rebar φ14@25 cm are assembled with intra-row spacing of 55 cm and the bottom plate 4-3 is a bottom plate of a ballastless track (equivalent to an inverted arch filling layer).

As shown in FIGS. 1-3, preferably, for convenient construction and later maintenance of the top (a portion above the protective layer 1-4) of the karst cave and the foundation pit 3, before step (I), an emptying culvert 2 is built at a position 35-45 m beside the main tunnel 1 firstly, where the emptying culvert 2 is parallel to the main tunnel 1, and a bottom surface of the emptying culvert 2 is lower than the bottom plate 4-3 by 2 m or more in height.

A cross passage 2-1 is built between the main tunnel 1 and the emptying culvert 2, and the cross passage 2-1 is a construction passage between the main tunnel 1 and the emptying culvert 2, where an included angle of 45° is formed between the cross passage 2-1 and the main tunnel 1.

A construction cross passage 2-2 is built between the emptying culvert 2 and a space below the arch bridge 4 and above the foundation pad 3-1, the construction cross passage 2-2 is a construction channel between the emptying culvert 2 and the cavity foundation pit, and a gradient of the construction cross passage 2-2 is not greater than 15%.

A circuitous passage 2-3 is built between the cross passage 2-1 and an upper portion (the upper portion refers to an upper portion of a bottom edge of the protective layer 1-4) of the protective layer 1-4, as shown in FIG. 7, a bottom edge of an opening, at the upper portion of the protective layer 1-4, of the circuitous passage 2-3 coincides with a bottom edge of the protective layer 1-4 or is slightly lower than the bottom edge of the protective layer 1-4, for the purpose of outflow of falling rock and inrush water of the upper portion of the protective layer. The circuitous passage 2-3 is a passage for exploring the karst cave and maintaining the top of the karst cave in a later stage. Furthermore, when falling rock and inrush water occur at the top of the karst cave, the falling rock and inrush water may flow into the circuitous passage 2-3 along a slope and the bottom edge of the protective layer 1-4 and flow into the emptying culvert 2 along the circuitous passage 2-3.

After the arch bridge 4 is erected, in order to improve a bearing capacity, after step (III), a vertical bearing wall 4-4, which is 30 cm in thickness, is built between the arch bridge 4 and the foundation pad 3-1, and a bottom of the vertical bearing wall 4-4 is arranged on the intermediate beam 3-12 of the foundation pad 3-1. As shown in FIG. 6, for convenient later maintenance of the foundation pit 3, a passage door 4-41 is built on the vertical bearing wall 4-4, and openings, on a wall of the karst cave and below the arch bridge 4, of the construction cross passage 2-2 are located on two sides of the vertical bearing wall 4-4.

Apparently, those skilled in the art may make various modifications and variations to the present invention without departing from the spirit and scope of the present invention. In this way, if these modifications and variations of the present invention fall within the scope of the claims of the present invention and their equivalent technologies, the present invention is also intended to include these modifications and variations.

What is claimed is:

1. A reinforcement system at a railway tunnel section passing through a karst cave with a large dip angle, specifically comprising:

an umbrella arch (1-1), a concrete layer (1-2), a flexible buffer layer (1-3) and a protective layer (1-4) which are sequentially built at a top of a portion, of a main tunnel (1) from bottom to top, passing through the karst cave; and an arch bridge (4) which is built at a bottom of a portion, of the main tunnel (1), passing through the karst cave, wherein a filling layer (4-1) is arranged over the arch bridge (4), two arched door openings (4-2) are reserved at portions, on two sides of the arch bridge (4), of the filling layer (4-1), a bottom plate (4-3) is arranged over the filling layer (4-1), a foundation pad (3-1) is arranged at a bottom of a foundation pit (3) under the arch bridge (4), and a vertical bearing wall (4-4) is built between the arch bridge (4) and the foundation pad (3-1).

2. The reinforcement system at a railway tunnel section passing through a karst cave with a large dip angle according to claim 1, further comprising an emptying culvert (2) parallel to the main tunnel (1), a bottom surface of the emptying culvert (2) being lower than the bottom plate (4-3) in height.

3. The reinforcement system at a railway tunnel section passing through a karst cave with a large dip angle according to claim 2, wherein a cross passage (2-1) is built between the main tunnel (1) and the emptying culvert (2);

a construction cross passage (2-2) is built between the emptying culvert (2) and a lower portion of the arch bridge (4), openings of the construction cross passage (2-2) being located on two sides of the vertical bearing wall (4-4); and a circuitous passage (2-3) is built between the cross passage (2-1) and an upper portion of the protective layer (1-4).

4. The reinforcement system at a railway tunnel section passing through a karst cave with a large dip angle according to claim 3, wherein the protective layer (1-4) is in a shape of a cone with a lower portion wider than an upper portion, and a cone top inclining to a side far away from the circuitous passage (2-3).

5. The reinforcement system at a railway tunnel section passing through a karst cave with a large dip angle according to claim 1, wherein the foundation pad (3-1) comprises a ring beam (3-11), an intermediate beam (3-12) and a pad layer (3-13), several anchor cables (3-14) penetrating into a wall of the karst cave are arranged at half of a height of the foundation pad (3-1), and the vertical bearing wall (4-4) is arranged on the intermediate beam (3-12).

6. A construction method of a reinforcement system at a railway tunnel section passing through a karst cave with a large dip angle, specifically comprising:

(I) building a protection at a tunnel top building an umbrella arch (1-1) at a top of a portion, of a main tunnel (1), passing through a karst cave, filling a top of the umbrella arch (1-1) with plain concrete to form a concrete layer (1-2), stacking a sandbag on the concrete layer (1-2) to serve as a flexible buffer layer (1-3), and pouring reinforced concrete at a top of the flexible buffer layer (1-3) to form a protective layer (1-4);

(II) building a foundation pit excavating the foundation pit (3) at a bottom of a portion, of the main tunnel (1), passing through the karst cave;

driving, after excavation, anchor cables (3-14) into walls of the karst cave on a periphery of a bottom of the foundation pit (3) for fixing, wherein a free end of one anchor cable (3-14) and a free end of another anchor cable (3-14) driven into opposite walls of the karst cave are fastened together by a buckle (3-15); and erecting reinforced beams on the periphery and in a middle of the bottom of the foundation pit (3), wherein the anchor cables (3-14) are located at halves of heights of the erected reinforced beams, pouring concrete to form a ring beam (3-11) and an intermediate beam (3-12), pouring concrete in a space between the ring beam (3-11) and the intermediate beam (3-12) to form a pad layer (3-13), and building a foundation pad (3-1); and (III) building an arch bridge erecting, after step (II), an arch bridge (4) by using reinforced concrete, pouring plain concrete at a top of the arch bridge (4) to form a filling layer (4-1), and pouring reinforced concrete on an upper portion of the filling layer (4-1) to serve as a bottom plate (4-3).

7. The construction method of the reinforcement system at a railway tunnel section passing through a karst cave with a large dip angle according to claim 6, further comprising:

before step (I), building an emptying culvert (2) beside the main tunnel (1) firstly, wherein the emptying culvert (2) is parallel to the main tunnel (1), and a bottom surface of the emptying culvert (2) is lower than the bottom plate (4-3) in height;

building a cross passage (2-1) between the main tunnel (1) and the emptying culvert (2), wherein an included angle of 45° is formed between the cross passage (2-1) and the main tunnel (1);

building a construction cross passage (2-2) between the emptying culvert (2) and a space below the arch bridge (4) and above the foundation pad (3-1); and building a circuitous passage (2-3) between the cross passage (2-1) and an upper portion of the protective layer (1-4), a bottom edge of an opening, at the upper portion of the protective layer (1-4), of the circuitous passage (2-3) coincides with a bottom edge of the protective layer (1-4) or is slightly lower than the bottom edge of the protective layer (1-4).

8. The construction method of the reinforcement system at a railway tunnel section passing through a karst cave with a large dip angle according to claim 7, further comprising: after step (III), building a vertical bearing wall (4-4) between the arch bridge (4) and the foundation pad (3-1), and a bottom of the vertical bearing wall (4-4) is arranged on the intermediate beam (3-12).

9. The construction method of the reinforcement system at a railway tunnel section passing through a karst cave with a large dip angle according to claim 8, further comprising:

building a passage door is built on the vertical bearing wall (4-4), and openings of the construction cross passage (2-2) are located on two sides of the vertical bearing wall (4-4).

10. The construction method of the reinforcement system at a railway tunnel section passing through a karst cave with a large dip angle according to claim 7, wherein the protective layer (1-4) is in a shape of a cone with a lower portion wider than an upper portion, and a cone top inclining to a side far away from the circuitous passage (2-3).

* * * * *